US011830653B2

(12) United States Patent
Yang et al.

(10) Patent No.: US 11,830,653 B2
(45) Date of Patent: Nov. 28, 2023

(54) COIL ELECTRONIC COMPONENT

(71) Applicant: SAMSUNG ELECTRO-MECHANICS CO., LTD., Suwon-si (KR)

(72) Inventors: Ju Hwan Yang, Suwon-si (KR); Byung Soo Kang, Suwon-si (KR); Yoon Mi Cha, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 1069 days.

(21) Appl. No.: 16/529,531

(22) Filed: Aug. 1, 2019

(65) Prior Publication Data

US 2020/0286672 A1 Sep. 10, 2020

(30) Foreign Application Priority Data

Mar. 6, 2019 (KR) ..... 10-2019-0025755

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/255* (2013.01); *H01F 27/29* (2013.01);
(Continued)

(58) Field of Classification Search
CPC ..... H01F 27/2804
(Continued)

(56) References Cited

U.S. PATENT DOCUMENTS 10,854,383 B2 12/2020 Choi
11,476,037 B2 10/2022 Kim et al.
(Continued)

FOREIGN PATENT DOCUMENTS

CN 101946024 A 1/2011
CN 102347315 A 2/2012
(Continued)

OTHER PUBLICATIONS

Office Action issued in corresponding Japanese Patent Application No. 2019-140870 dated Mar. 24, 2020, with English translation.
(Continued)

*Primary Examiner* — Ronald Hinson
(74) *Attorney, Agent, or Firm* — Morgan, Lewis & Bockius LLP

(57) ABSTRACT

A coil electronic component includes a body having a first surface and a second surface opposing each other and a third and a fourth surface opposing each other, an insulating substrate disposed inside the body, first and second coil portions respectively disposed on opposing surfaces of the insulating substrate, a first lead-out portion connected the first coil portion and exposed from the first and third surfaces, a second lead-out portion connected to the second coil portion and exposed from the second and third surfaces, and first and second external electrodes respectively covering the first and second lead-out portions. The insulating substrate includes a support portion supporting the first and second coil portions, a first tip exposed from the first and third surfaces and supporting the first lead-out portion, and a second tip exposed from the second and third surfaces and supporting the second lead-out portion.

33 Claims, 3 Drawing Sheets

(51) Int. Cl.

| | |
|---|---|
| ***H01F 27/29*** | (2006.01) |
| ***H01F 27/32*** | (2006.01) |
| ***H01F 41/12*** | (2006.01) |
| ***H01F 41/04*** | (2006.01) |
| ***H01F 27/255*** | (2006.01) |

(52) U.S. Cl.
CPC ..... *H01F 27/323* (2013.01); *H01F 41/041* (2013.01); *H01F 41/122* (2013.01); *H01F 2027/2809* (2013.01)

(58) Field of Classification Search
USPC ..... 336/200
See application file for complete search history.

(56) References Cited

U.S. PATENT DOCUMENTS

| | | | | |
|---|---|---|---|---|
| 2012/0018204 | A1 | 1/2012 | Sato et al. | |
| 2012/0274432 | A1* | 11/2012 | Jeong | H01F 27/2804 336/192 |
| 2014/0009254 | A1* | 1/2014 | Ohkubo | H01F 17/0033 336/192 |
| 2015/0035634 | A1* | 2/2015 | Nakamura | H01F 41/046 336/170 |
| 2015/0102891 | A1* | 4/2015 | Yoon | H01F 27/2804 336/200 |
| 2016/0268038 | A1* | 9/2016 | Choi | H01F 27/255 |
| 2016/0276089 | A1 | 9/2016 | Inoue et al. | |
| 2016/0372261 | A1 | 12/2016 | Ozawa | |
| 2017/0018351 | A1 | 1/2017 | Yatabe et al. | |
| 2017/0032882 | A1* | 2/2017 | Yang | H01F 27/2804 |
| 2017/0084376 | A1 | 3/2017 | Kubota et al. | |
| 2018/0012696 | A1 | 1/2018 | Lee et al. | |
| 2018/0096778 | A1 | 4/2018 | Yatabe et al. | |
| 2018/0122555 | A1 | 5/2018 | Kim et al. | |
| 2018/0268990 | A1 | 9/2018 | Lee et al. | |
| 2018/0286559 | A1 | 10/2018 | Ji et al. | |
| 2019/0189338 | A1* | 6/2019 | Kim | H01F 17/0013 |
| 2020/0082986 | A1 | 3/2020 | Yaso | |

FOREIGN PATENT DOCUMENTS

| | | | |
|---|---|---|---|
| CN | 104575946 | A | 4/2015 |
| CN | 105957692 | A | 9/2016 |
| JP | 6-290975 | A | 10/1994 |
| JP | 2006-108383 | A | 4/2006 |
| JP | 2006-253394 | A | 9/2006 |
| JP | 2012-235080 | A | 11/2012 |
| JP | 2015-79958 | A | 4/2015 |
| JP | 2016-178282 | A | 10/2016 |
| JP | 2017-11044 | A | 1/2017 |
| JP | 2017-22304 | A | 1/2017 |
| JP | 2018-157189 | A | 10/2018 |
| KR | 10-2015-0114924 | A | 10/2015 |
| KR | 10-2016-0040422 | A | 4/2016 |
| KR | 10-2018-0006246 | A | 1/2018 |
| KR | 10-2018-0036610 | A | 4/2018 |
| KR | 10-1858117 | B1 | 5/2018 |
| KR | 10-2018-0110448 | A | 10/2018 |
| TW | 201812805 | A | 4/2018 |
| TW | 201909209 | A | 3/2019 |
| WO | 2016/013643 | A1 | 1/2016 |
| WO | 2018/048135 | A1 | 3/2018 |

OTHER PUBLICATIONS

Office Action issued in corresponding Korean Patent Application No. 10-2019-0025755 dated Mar. 3, 2010, with English translation.
Office Action issued in corresponding Japanese Patent Application No. 2019-140870 dated Sep. 23, 2020, with English translation.
Japanese Office Action dated Oct. 19, 2021 , issued in corresponding Japanese Patent Application No. 2019-140870.
Chinese Office Action dated Feb. 19, 2023, issued in corresponding Chinese Patent Application No. 201911004007.X with English translation.
Chinese Office Action dated Aug. 31, 2023, issued in corresponding Chinese Patent Application No. 201911004007.X with English translation.

* cited by examiner

COIL ELECTRONIC COMPONENT

CROSS-REFERENCE TO RELATED APPLICATION(S)

This application claims benefit of priority to Korean Patent Application No. 10-2019-0025755 filed on Mar. 6, 2019 in the Korean Intellectual Property Office, the disclosure of which is incorporated herein by reference in its entirety.

TECHNICAL FIELD

The present disclosure relates to a coil electronic component.

BACKGROUND

Recently, as information technology (IT) devices such as communications devices, display devices, and the like, have been increasingly miniaturized and thinned, research into technologies facilitating the miniaturizing and thinning of various elements such as inductors, capacitors, transistors, and the like, used in such IT devices, has been continuously undertaken. In this regard, inductors have been rapidly replaced by chips having a small size and high density, capable of being automatically surface-mounted. In addition, a thin-film type device, manufactured by forming a coil pattern on top and bottom surfaces of an insulating substrate by a plating process and laminating, pressing, and curing a magnetic sheet, in which magnetic powder particles and a resin are mixed, on an upper portion and a lower portion of the coil pattern, has been developed.

However, as a chip size of the thin-film type inductor has also been decreased, the volume of a body has been reduced. Accordingly, a space for forming a coil in the body is also reduced, and the number of turns of the formed coil is decreased.

As described above, when an area, in which a coil is formed, is reduced, it may be difficult to secure high capacitance and a width of the coil may be decreased. Thus, DC resistance and AC resistance may be increased and a quality factor Q may be lowered.

In order to achieve high capacitance and a high quality factor Q even if a chip size is decreased, a coil needs to be formed to occupy as large an area as possible in a miniaturized body. In addition, inductor performance such as inductance L, a quality factor Q, and the like, needs to be improved by increasing an area of an internal coil and allowing magnetic flux to flow smoothly.

SUMMARY

An aspect of the present disclosure is to provide a coil electronic component which may achieve high capacitance in spite of a decrease in chip size by increasing an area in which a coil portion is formed within the same chip size.

An aspect of the present disclosure is to provide a coil electronic component which may improve performance such as inductance L, a quality factor Q, and the like, by significantly reducing an influence of a mounting substrate and an external electrode interfering with a flow of magnetic flux.

An aspect of the present disclosure is to provide a coil electronic component which may achieve an improvement in performance by increasing an area of a core portion in a coil portion, a degree of freedom in design of a margin portion between an outermost portion of the coil portion and an exterior of a body, and the like, which is limited as a chip size is decreased.

According to an aspect of the present disclosure, a coil electronic includes a body having a first surface and a second surface opposing each other, and a third and a fourth surface opposing each other and connecting the first surface and the second surface to each other, an insulating substrate disposed inside the body, first and second coil portions respectively disposed on opposing surfaces of the insulating substrate, a first lead-out portion connected to one end of the first coil portion and exposed from the first surface and the third surface of the body, a second lead-out portion connected to one end of the second coil portion and exposed from the second surface and the third surface of the body, and first and second external electrodes respectively covering the first and second lead-out portions. The insulating substrate includes a support portion supporting the first and second coil portions, a first tip exposed from the first and third surfaces of the body and supporting the first lead-out portion, and a second tip exposed from the second and third surfaces of the body and supporting the second lead-out portion.

According to an aspect of the present disclosure, a coil electronic includes a body having a first surface and a second surface opposing each other, and a third and a fourth surface opposing each other and connecting the first surface and the second surface to each other; an insulating substrate disposed inside the body; first and second coil portions respectively disposed on opposing surfaces of the insulating substrate; a first lead-out portion disposed on the insulating substrate, connected to one end of the first coil portion, and exposed from the first surface and the third surface of the body; a second lead-out portion disposed on the insulating substrate, connected to one end of the second coil portion, and exposed from the second surface and the third surface of the body; and first and second external electrodes respectively covering the first and second lead-out portions. Each of the first and second external electrodes includes a first conductive layer disposed on a respective one of the first and second lead-out portions, and a second conducive layer covering the first conducive layer. The first conductive layer has a concave portion on a portion of the insulating substrate exposed from the body.

According to an aspect of the present disclosure, a coil electronic includes a body having a first surface and a second surface opposing each other, and a third and a fourth surface opposing each other and connecting the first surface and the second surface to each other; an insulating substrate disposed inside the body; first and second coil portions respectively disposed on opposing surfaces of the insulating substrate; a first lead-out portion disposed on the insulating substrate, connected to one end of the first coil portion, and exposed from the first surface and the third surface of the body; a second lead-out portion disposed on the insulating substrate, connected to one end of the second coil portion, and exposed from the second surface and the third surface of the body; first and second external electrodes respectively covering the first and second lead-out portions; and an oxide covering portions of the body.

The body may be 1608-sized or less.

The coil portion may be formed to be parallel to the first surface and the second surface of the body.

The coil portion may be formed to stand upright with respect to the third surface or the fourth surface of the body at an angle of 80 to 100 degrees.

The first and second external electrodes, respectively covering the first and second lead-out portions, maybe formed to extend to the first surface, the second surface, and the third surface of the body, but may not be formed on the fourth surface of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
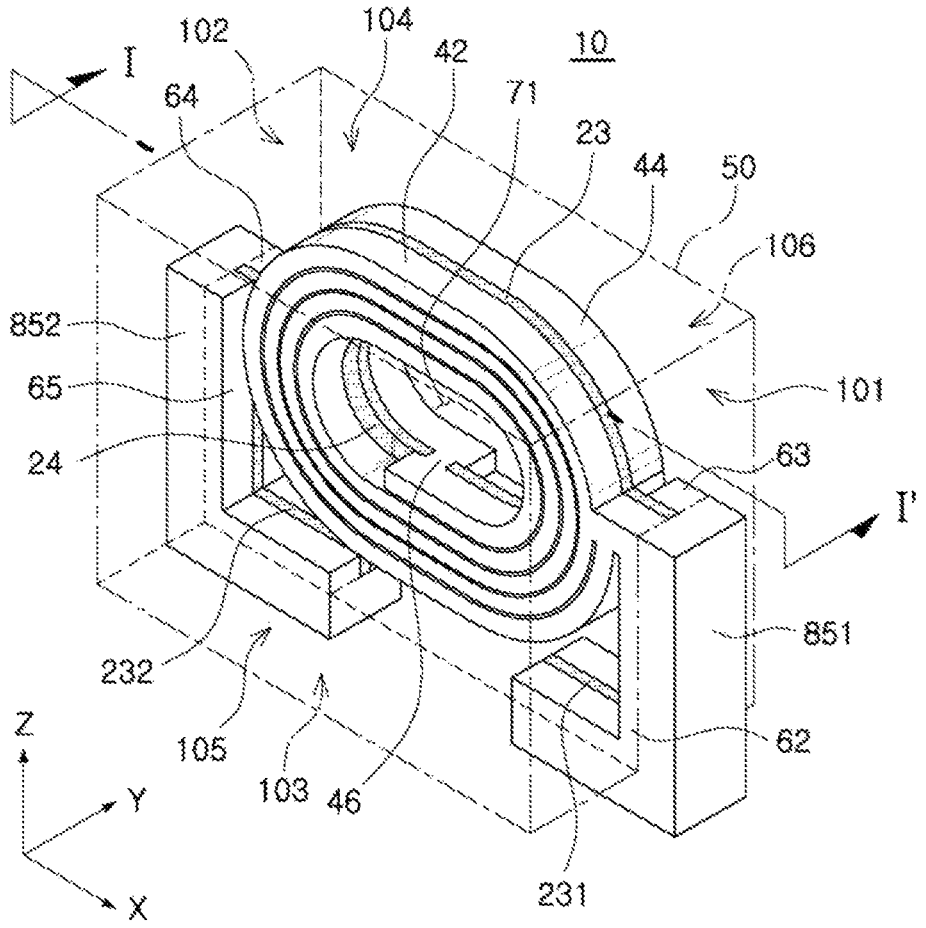
FIG. 1 is a schematic perspective view illustrating a coil portion of a coil electronic component according to an embodiment in the present disclosure.

The terminology used herein to describe embodiments of the present disclosure is not intended to limit the scope of the present disclosure. The articles "a, " and "an" are singular in that they have a single referent, however the use of the singular form in the present document should not preclude the presence of more than one referent. In other words, elements of the present disclosure referred to in the singular may number one or more, unless the context clearly indicates otherwise. It will be further understood that the terms "comprise," "comprising," "include," and/or "including," when used herein, specify the presence of stated features, numbers, steps, operations, elements, and/or components but do not preclude the presence or addition of one or more other features, numbers, steps, operations, elements, components, and/or groups thereof.

In a description of the embodiment, in a case in which any one element is described as being formed on (or under) another element, such a description includes both a case in which the two elements are formed to be in direct contact with each other and a case in which the two elements are in indirect contact with each other such that one or more other elements are interposed between the two elements. In addition, when in a case in which one element is described as being formed on (or under) another element, such a description may include a case in which the one element is formed at an upper side or a lower side with respect to the another element.

Also, the sizes of components in the drawings may be exaggerated for convenience of description. In other words, since the sizes and thicknesses of components in the drawings are arbitrarily illustrated for convenience of description, the following embodiments are not limited thereto.

In the drawing, an X direction will be defined as a first direction or a length direction, a Y direction will be defined as a second direction or width direction, and a Z direction will be defined as a third direction or thickness direction.

Hereinafter, the exemplary embodiments of the present disclosure will be described in detail with reference to the accompanying drawings. The same or corresponding elements will be consistently denoted by the same respective reference numerals and described in detail no more than once regardless of drawing symbols.

Various types of electronic components are used in an electronic device. Various types of coil components may be appropriately used between such electronic components for the purpose of noise removal or the like.

In an electronic device, a coil component may be used as, for example, a power inductor, a high-frequency (HF) inductor, a general bead, a bead for high frequency (GHz Bead), a common mode filter, and the like.

Hereinafter, the present disclosure will be described under the assumption that a coil electronic component 10 according to example embodiments is a thin-film inductor used in a power line of a power supply circuit. However, a coil electronic component according to example embodiments may be appropriately applied to a chip bead, a chip filter, or the like in addition to the thin-film inductor.

Embodiment 1

Figure 2:
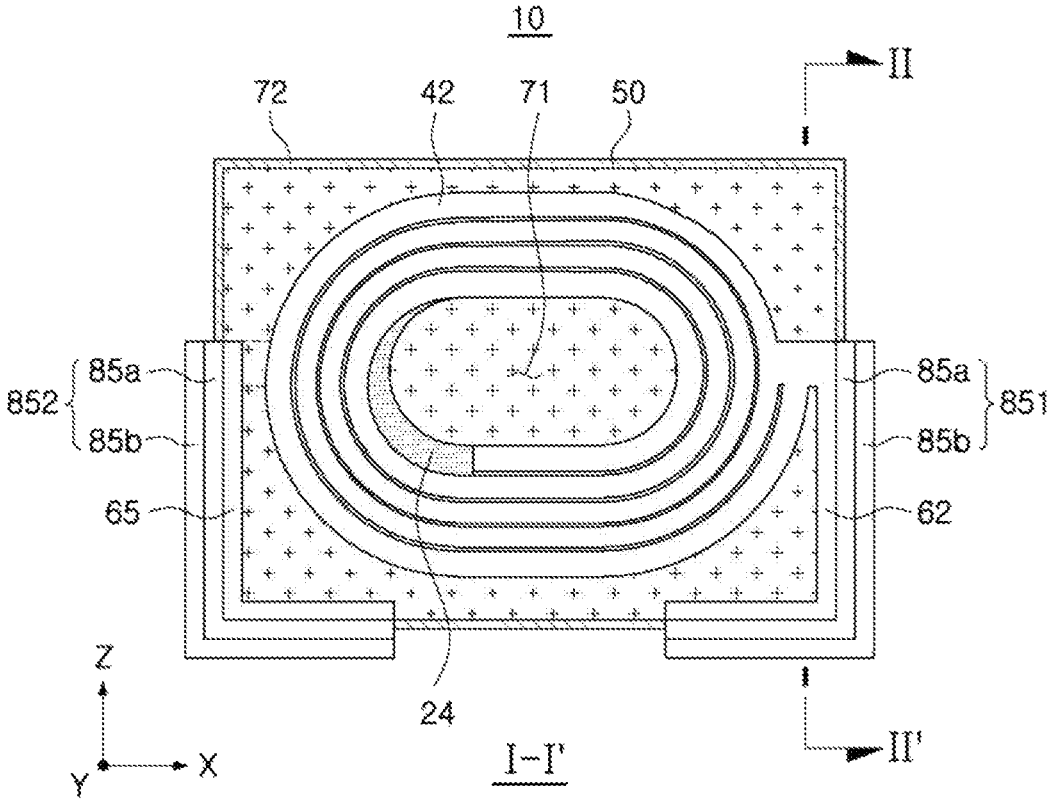
FIG. 2 is a cross-sectional view taken along line I-I' of the coil electronic component illustrated in FIG. 1.
Figure 3:
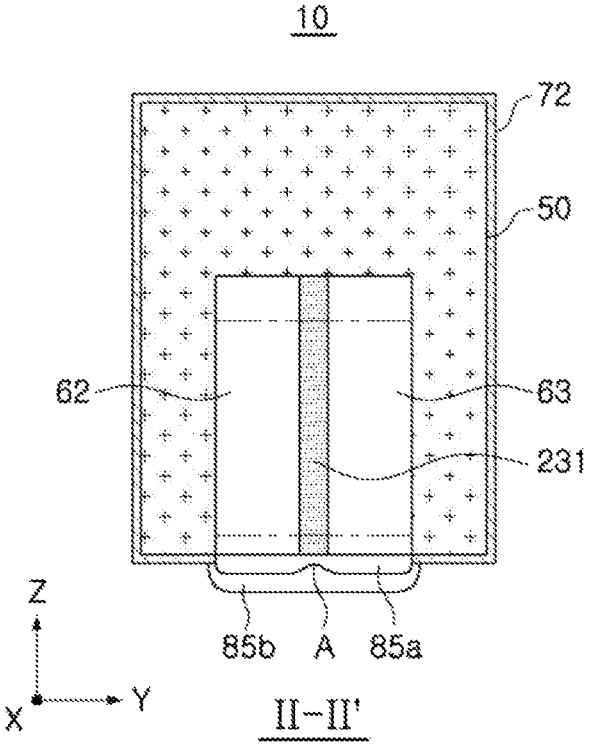
FIG. 3 is a cross-sectional view taken along line II-II' of the coil electronic component according to an example embodiment in the present disclosure illustrated in FIG. 2.

FIG. 1 is a schematic perspective view illustrating a coil portion of a coil electronic component according to an embodiment in the present disclosure. FIG. 2 is a cross-sectional view taken along line I-I' of the coil electronic component illustrated in FIG. 1. FIG. 3 is a cross-sectional view taken along line II-II' of the coil electronic component according to an example embodiment in the present disclosure illustrated in FIG. 2.

Referring to FIGS. 1 to 3, a coil electronic component 10 according to an example embodiment includes a body 50, an insulating substrate 23, coil portions 42 and 44, lead-out portions 62 and 64, and external electrodes 851 and 852, and may further include dummy lead-out portions 63 and 65 and an insulating layer 72.

The body 50 may form an exterior of the electronic component 10, and the insulating substrate 23 is disposed in the body 50.

The body 50 may be formed to have an approximately hexahedral shape.

The body 50 has a first surface 101 and a second surface, opposing each other in an X direction, a third surface 103 and a fourth surface 104, opposing each other in a Z direction, and a fifth surface 105 and a sixth surface 106 opposing each other in a Y direction. Each of the third and fourth surfaces 103 and 104, opposing each other, may connect the first and second surfaces 101 and 102 to each other.

As an example, the body 50 may be formed such that the coil electronic component 10, on which the external electrodes 851 and 852 to be described later are disposed, has a length of 0.2±0.1 mm, a width of 0.25±0.1 mm, and a maximum thickness of 0.4 mm, but the length, the width, and the thickness thereof are not limited thereto.

The body 50 may include a magnetic material and an insulating resin. Specifically, the body 50 may be formed by laminating an insulating resin and at least one magnetic sheet including a magnetic material dispersed in the insulating resin. However, the body 50 may have another structure, other than the structure in which the magnetic materials are disposed in the insulating resin. For example, the body 50 may include a magnetic material such as ferrite.

The magnetic material may be ferrite or metal magnetic powder particles.

The ferrite powder particles may be at least one of, for example, spinel type ferrites such as ferrites that are Mg—Zn-based, Mn—Zn-based, Mn—Mg-based, Cu—Zn-based, Mg—Mn—Sr-based, Ni—Zn-based, hexagonal ferrites such as ferrites that are Ba—Zn-based, Ba—Mg-based, Ba—Ni-based, Ba—Co-based, Ba—Ni—Co-based, or the like, garnet ferrites such as Y-based ferrite, and Li-based ferrite.

The metal magnetic powder particles may include at least one selected from a group consisting of iron (Fe) , silicon (Si) , chromium (Cr), cobalt (Co), molybdenum (Mo), aluminum (Al), niobium (Nb), copper (Cu), and nickel (Ni). For example, the metal magnetic powder particles may include at least one of pore ion power particles, Fe-Si-based alloy powder particles, Fe—Si—Al-based alloy powder particles, Fe—Ni-based alloy powder particles, Fe—Ni—Mo-based alloy powder particles, Fe—Ni—Mo—Cu-based alloy powder particles, Fe—Co-based alloy powder particles, Fe—Ni—Co-based alloy powder particles, Fe—Cr-based alloy powder particles, Fe—Cr—Si-based alloy powder particles, Fe—Si—Cu—Nb-based alloy powder particles, Fe—Ni—Cr-based alloy powder particles, and Fe—Cr—Al-based alloy powder particles.

The metal magnetic powder particles may be amorphous or crystalline. For example, the metal magnetic powder particles may Fe—Si—B—Cr based amorphous alloy powder particles, but are not limited thereto.

Each of the ferrite and metal magnetic powder particles may have an average diameter of about 0.1 μm to about 30 μm, but the average diameter is not limited thereto.

The body 50 may include two or more types of magnetic materials dispersed in a resin. The expression "different types of magnetic materials" refers to the fact that magnetic materials, dispersed in a resin, are distinguished from each other by any one of average diameter, composition, crystallinity, and shape.

The insulating resin may include epoxy, polyimide, liquid crystal polymer, and the like, alone or in combination, but is not limited thereto.

The insulating substrate 23 may be disposed inside the body 50 and may have both surfaces on which the first and second coil portions 42 and 44 are disposed, respectively. The insulating substrate 23 may include a support portion 24, supporting the coil portions 42 and 44, and tips 231 and 232 supporting the lead-out portions 62 and 64. The support portion 24 and the tips 231 and 232 will be described later.

The insulating substrate 23 may have a thickness of 10 micrometers (μm) or more to 60 μm or less. When the thickness of the insulating substrate 23 maybe less than 10 μm, electrical short-circuit may occur between the coil portions 42 and 44. When the thickness of the insulating substrate 23 is greater than 60 μm, a thickness of the coil electronic component 10 may be increased to cause a disadvantage to thinning. Ls(pH) increased by 7.2% and Isat(A) increased by 8.9% when the insulating substrate 23 had a thickness of 30 μm, as compared with when the insulating substrate 23 had a thickness of 60 μm. Ls (μH) increased by 2.5% and Isat (A) increased by 2.2% when the insulating substrate 23 had a thickness of 20 μm, as compared with when the insulating substrate 23 had a thickness of 30 μm.

The insulating substrate 23 may be formed of an insulating material including a thermosetting resin such as an epoxy resin, a thermoplastic resin such as a polyimide resin, or an insulating a photosensitive insulating resin, or an insulating material in which such an insulating resin is impregnated with a reinforcing material such as glass fiber and inorganic filler. For example, the insulating substrate 23 may be formed of an insulating material such as prepreg, Ajinomoto Build-up Film (ABF), FR-4, a Bismaleimide Triazine (BT) film, a photoimageable dielectric (PID) film, or the like, but an insulating material of the insulating substrate 23 is not limited thereto.

The inorganic filler may be at least one selected from the group consisting of silica ($SiO_2$) , alumina ($A1_2O_3$) , silicon carbide (SiC), barium sulfate ($BaSO_4$), talc, clay, mica powder particles, aluminum hydroxide ($AlOH_3$), magnesium hydroxide ($Mg(OH)_2$), a calcium carbonate ($CaCO_3$), magnesium carbonate ($MgCO_3$), magnesium oxide (MgO), boron nitride (BN), aluminum borate ($AlBO_3$) , barium titanate ($BaTiO_3$) , and calcium zirconate ($CaZrO_3$).

The insulating substrate 23 may provide better rigidity when it is formed of an insulating material which includes a reinforcing material. The insulating substrate 23 may be advantageous in reducing an entire thickness of the coil portions 42 and 44 when it is formed of an insulating material which does not include a glass fiber. When the insulating substrate 23 is formed of an insulating material including a photosensitive insulating resin, the number of processes of forming the coil portions 42 and 44 may be decreased to be advantageous in reducing manufacturing costs and to forma fine via.

The support portion 24 may be one region disposed between the first and second coil portions 42 and 44 of the insulating layer 23 to support the coil portions 42 and 44.

The tips 231 and 232 may extend from the support portion 24 of the insulating substrate 23 to support the lead-out portions 62 and 64 and the dummy lead-out portions 63 and 65.

Specifically, a first tip 231 may be disposed between a first lead-out portion 62 and a first dummy lead-out portion 63 to support the first lead-out portion 62 and the first dummy lead-out portion 63. A second tip 232 may be disposed between a second lead-out portion 64 and a second dummy lead-out portion 65 to support the second lead-out portion 64 and the second dummy lead-out portion 65.

The tips 231 and 232 refers to regions extending from the lead-out portions 62 and 64, disposed on the first surface 101 and the second surface 102 of the body 50, to regions corresponding to the lead-out portions 62 and 64, disposed on the third surface 103 of the body 50, respectively.

The coil portions 42 and 44 may be respectively disposed on both surfaces of the insulating substrate 23, and may exhibit characteristics of a coil electronic component. For example, when the coil electronic component 10 according to an example embodiment is used as a power inductor, the coil portions 42 and 44 may store an electric field as a magnetic field and maintain an output voltage to stabilize power of an electronic device.

According to an example embodiment, the first and second coil portions 42 and 44 may be formed to stand upright with respect to the third surface 103 or the fourth surface of the body 50.

As illustrated in FIG. 1, the expression "formed to stand upright with respect to the third surface 103 or the fourth surface 104 of the body 50" refers to the fact that contact surfaces between the coil portions 42 and 44 and the insulating substrate 23 are formed to be perpendicular or substantially perpendicular to the third surface 103 or the fourth surface 104 of the body 50. For example, the contact surfaces between the coil portions 42 and 44 and the insulating substrate 23 may be formed to stand upright with respect to the third surface 103 or the fourth surface 104 of the body 50 at an angle of 80 to 100 degrees.

As the body 50 is miniaturized to be 1608-sized, 1006-sized or less, a body 50 having a thickness greater than a width is formed and a cross-sectional area of the body 50 in an XZ direction is larger than a cross-sectional area of the body 50 in an XY direction. Therefore, the coil portions 42 and 44 maybe formed to stand upright with respect to the third surface 103 or the fourth surface 104 of the body 50 to increase an area in which the coil portions 42 and 44 may be formed.

For example, when the body 50 has a length of 1.6±0.2 mm and a width is 0.8±0.05 mm, a thickness of the body 50 may satisfy a range of 1.0±0.05 mm (1608 size). When the body 50 has a length of 0.2±0.1 mm and a width of 0.25±0.1 mm, a thickness of the body 50 may satisfy a maximum range of 0.4 mm (1006 size). Since the thickness of the body 50 is greater than the width of the body 50, a larger area maybe secured when the coil potions 42 and 44 is vertical to the third surface 103 or the fourth surface 104 of the body 50 than when the coil potions 42 and 44 is horizontal to the third surface 103 or the fourth surface 104 of the body 50. The larger the area in which the coil portions 42 and 44 are formed, the higher inductance L and quality factor Q.

Each of the first and second coil portions 42 and 44 may have a flat spiral shape forming at least one turn about a core portion 71. As an example, the first coil portion 42 may form at least one turn about the core portion on one surface of the insulating substrate 23.

The coil portions 42 and 44 may include a coil pattern having a flat spiral shape. In the insulating substrate 23, the coil portions 42 and 44, disposed on both surfaces opposing each other, maybe electrically connected to each other through a via electrode 46 formed in the insulating substrate 23.

The coil portions 42 and 44 and the via electrode 46 may include a metal having improved electrical conductivity. For example, the coil portions 42 and 44 and the via electrode 46 maybe formed of silver (Ag) , palladium (Pd) , aluminum (Al), nickel (Ni), titanium (Ti), gold (Au), copper (Cu), platinum (Pt), or alloys thereof.

The lead-out portions 62 and 64 may be exposed from the first surface 101 and a second surface 102 of the body 50, respectively. Specifically, the first lead-out portion 62 and the first dummy lead-out portion 63 maybe exposed from the first surface 101 of the body 50, and the second lead-out portion 64 and the second dummy lead-out portion 65 may be exposed from the second surface 102 of the body 50.

Referring to FIGS. 1 and 2, one end of the first coil portion 42, disposed on one surface of the insulating substrate 23, may extend to form the first lead-out portion 62, and the first lead-out portion 62 may be exposed from the first surface 101 and the third surface 103 of the body 50. For example, the first lead-out portion 62 of the present disclosure may have a width narrower than a width of the body 50. In addition, one end of the second coil portion 44, disposed on an opposing surface of the insulating substrate 23, may extend to form the second lead-out portion 64, and the second lead-out portion 64 maybe exposed from the second surface 102 and the third surface 103 of the body 50. For example, the lead-out portion 64 of the present disclosure may have a width narrower than the width of the body 50. The first and second lead-out portions 62 and 64 extend from the first surface 101 and the second surface 102 to be led out to the third surface 103, and may not be disposed on the fourth surface 104, the fifth surface 105, and the sixth surface 106 of the body 50.

Referring to FIGS. 1 to 3, the first and second external electrodes 851 and 852 and the coil portions 42 and 44 are connected respectively through the lead-out portions 62 and 64, disposed inside the body 50, rather than directly connected through lead-out portions disposed outside a body. After a process of plating the coil portions 42 and 44, a process of trimming the insulating substrate 23 may be performed to form a structure in which the lead-out portions 62 and 64 is disposed inside the body 50. The structure, formed by the trimming process, may include a support portion 24 supporting the coil portions 42 and 44, a first tip 231 exposed from the first and third surfaces 101 and 103 of the body 50 and supporting the lead-out portion 62, and a second tip 232 exposed from the second and third surfaces 102 and 103 of the body 50 and supporting the second lead-out portion 62.

Since the first and second lead-out portions 62 and 64 may include a conductive metal such as copper (Cu) and the first and second lead-out portions 62 and 64 may be disposed inside the body 50, occurrence of a dimple, caused by a decrease in thickness of a plating layer, may be reduced as compared to a related art in which a plating layer is formed on a trimmed insulating substrate and external portions are disposed outside a body.

The dummy lead-out portions 63 and 65 may be disposed on one surface and the other surface of the insulating substrate 23 to correspond to the lead-out portions 62 and 64. According to an example embodiment, the coil electronic component 10 may further include a first dummy lead-out portion 63, disposed on a surface opposing the first lead-out portion 62 on the insulating substrate 23, and a second dummy lead-out portion 65 disposed on a surface opposing the second lead-out portion 64.

At least one of the coil portions 42 and 44, the via electrode 46, the lead-out portions 62 and 64, and the dummy lead-out portions 63 and 65 may include at least one conductive layer.

For example, when the coil portions 42 and 44, the dummy lead-out portions 63 and 65, and the via electrode 46 are formed on one surface or the other surface of the insulating substrate 23 by plating, each of the coil portions 42 and 44, the dummy lead-out portions 63 and 65, and the via electrode 46 may include a seed layer such as an electroless plating layer, or the like, and an electroplating layer. The electroplating layer may have a single-layer structure or a multilayer structure. An electroplating layer of a multilayer structure may have a conformal film structure in which one electroplating layer is covered with another electroplating layer, or may have a structure in which another electroplating layer is laminated on only one surface of one electroplating layer. A seed layer of the electroplating layer of the coil portions 42 and 44, a seed layer of the lead-out patterns 62 and 64, and a seed layer of the via electrode 46 maybe formed integrally with each other, such that boundaries therebetween may not be formed, but is not limited thereto. An electroplating layer of the coil portions 42 and 44, an electroplating layer of the dummy lead-out patterns 63 and 65, and an electroplating layer of the via electrode 46 may be formed integrally with each other, such that boundaries therebetween may not be formed, but is not limited thereto.

Each of the coil portions 42 and 44, the lead-out portions 62 and 64, the dummy lead-out portions 63 and 65, and the via electrode 46 may be formed of a conductive material such as copper (Cu), aluminum (Al), silver (Ag) (Sn), gold (Au), nickel (Ni), lead (Pb), titanium (Ti), or alloys thereof.

Referring to FIG. 3, the dummy lead-out portions 63 and 65 may be laminated adjacent to a magnetic sheets, in which the coil portions 42 and 44, the first lead-out portion 62, and the second lead-out portion 64 are disposed, to cause a greater number of metallic bondings to the first and second external electrodes 851 and 852 disposed on the first surface 101, the second surface 102, and the third surface 103 of the body 50 and to improve bonding force between the coil portions 42 and 44 and the external electrodes 851 and 852 and between an electronic component and a printed circuit board (PCB).

The first dummy lead-out portion 63 and the first lead-out portion 62 are disposed to correspond to each other with the insulating substrate 23 interposed therebetween, such that a concave portion A is formed on a surface of a first layer 85*a* including a metal, as will be described later. For example, since the first layer 85*a* covers more of the first lead-out portion 62 and the first dummy lead-out portion 63 than the insulating substrate 23 including the insulating material, a concave portion A is relatively disposed in a region covering the insulating substrate 23. Similarly, the second dummy lead-out portion 65 and the second lead-out portion 64 are disposed to correspond to each other with the insulating substrate 23 interposed therebetween, such that a concave portion is also formed on a surface of a first layer, adjacent to the second surface 102, including a metal. Similarly, since such a first layer covers more of the second lead-out portion 65 and the second dummy lead-out portion 64 than the insulating substrate 23 including the insulating material, a concave portion is also relatively disposed in a region covering the insulating substrate 23 adjacent to the second surface 102.

The first external electrode 851 may be disposed on the first surface 101 and the third surface 103 of the body 50, and the second external electrode 852 may be disposed on the second surface 102 and the third surface 103 of the body 50.

According to an example embodiment, the first external electrode 851 may be disposed on the first surface 101 and the third surface 103 of the body 50 to be connected to the first lead-out portion 62 exposed from the first surface 101 and the third surface 103 of the body 50, and the second external electrode 852 may be disposed on the second surface 102 and the third surface 103 of the body 50 to be connected to the second lead-out portion 64 exposed from the second surface 102 and the third surface 103 of the body 50. The external electrodes 851 and 852 may be have a width narrower than a width of the body 50. The first external electrode 851 may be a structure, covering the first lead-out portion 62 and extending from the first surface 101 of the body 50 to be disposed on the third surface 103, but is not disposed on the fourth surface 104, the fifth surface 105, and the sixth surface 106 of the body 50. The second external electrode 852 may be a structure, covering the second lead-out portion 64 and extending from the second surface 102 of the body 50 to be disposed on the third surface 103, but is not disposed on the fourth surface 104, the fifth surface 105, and the sixth surface 106 of the body 50.

Since the external electrodes 851 and 852 are disposed on portions of the first surface 101, the second surface 102, and the third surface 103 of the body 50 and have the width narrower than the width of the body 50, an influence of the external electrodes 851 and 852, interfering with a flow of magnetic flux, maybe reduced to improve inductance performance such as inductance L, a quality factor Q, and the like.

The external electrodes 851 and 852 may have a single-layer structure or a multilayer structure. According to an example embodiment, the external electrodes 851 and 852 may each include a first layer 85*a*, respectively covering the lead-out portions 62 and 64, and a second layer 85*b* covering the first layer 85*a*. Specifically, a coil electronic component including the first layer 85*a*, including nickel (Ni), and the second layer 85*b*, including tin (Sn), is provided.

The concave portion A may be disposed on a surface of the first layer 85*a*. The concave portion A may be disposed in a region covering the insulating substrate 23 on the first layer 85*a*. Since electrical connectivity of the insulating substrate 23 is different from electrical connectivity of the lead-out portions 62 and 64, the first layer 85*a*, formed of a metal, is mainly plated on surfaces of the lead-out portions 62 and 64 and the dummy lead-out portions 63 and 65 . Accordingly, the first layer 85*a*, disposed on the first lead-out portion 62 and the first dummy lead-out portion 63, may have the concave portion A formed in a region corresponding to the first tip 231 of the insulating substrate 23, as illustrated in FIG. 3. Although not illustrated in the drawings, the first layer 85*a*, disposed on the second lead-out portion 64 and the first dummy lead-out portion 65, may also have a concave portion A disposed in a region corresponding to the second tip 232 of the insulating substrate 23.

The insulating layer 72 may be disposed on a surface of the body 50. Before the external electrodes 851 and 852 are formed by electroplating, the insulating layer 72 may be selectively formed on the surface of the body 50 to prevent plating from being performed on a region of the surface of the body 50, except for regions in which the external electrodes 851 and 852 are formed. Additionally, after the plating process, electrical short-circuit between a coil electronic component and another electronic component may be prevented.

According to an example embodiment, the insulating layer 72 is formed by acidizing metallic magnetic powder particles (for example, Fe-based magnetic powder particles) exposed from the surface of the body 50, which is different from an insulating layer according to a related art. For example, an etchant, selectively reacting with iron (Fe), may be used to selectively form an insulating layer, an Fe oxide layer, in a region of the surface of the body 50, except for regions in which the lead-out portions 62 and 64 and the dummy lead-out portions 63 and 65 are exposed. In this case, the insulating layer 72 is an oxide of a composition, for example, Fe-based magnetic material, composing metal magnetic powder particles disposed inside the body 50.

For example, the insulating layer 72 may include an oxide layer including a compound selected from the group consisting of Fe, Nb, Si, Cr, or alloys thereof. As described above, since the insulating layer 72 is formed by the acidizing, it may be formed on the surface of the body 50 to have a significantly small thickness. For example, a thickness of the insulating layer 72 may be less than that of the first layer 85*a*. Thus, thinning may be implemented as compare to a coil electronic component according to a related art.

Embodiment 2

Figure 4:
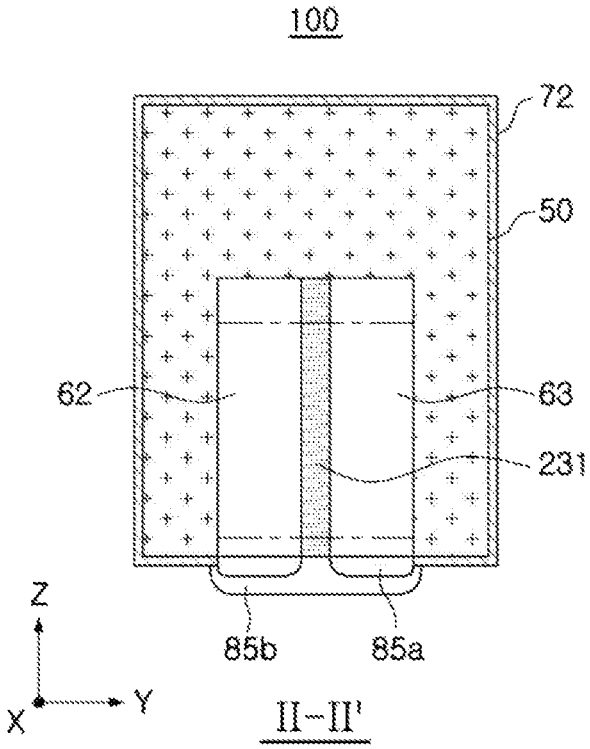
FIG. 4 is a cross-sectional view taken along line II-II' of the coil electronic component according to another example embodiment in the present disclosure illustrated in FIG. 2.

FIG. 4 is a cross-sectional view taken along line II-II' of the coil electronic component according to another example embodiment in the present disclosure illustrated in FIG. 2.

A coil electronic component 100 according to this embodiment is different, in a shape of a first layer 85*a*, from the coil electronic component 10 according to the first embodiment. Therefore, this embodiment will be described with a focus on the first layer 85*a*, which is different from that of the first embodiment. Descriptions of the other components of the second embodiment are the same as the descriptions of those of the first embodiment.

Referring to FIG. 4, external electrodes 851 and 852 may include a first layer 85*a*, covering the lead-out portions 62 and 64, and a second layer 85*b* covering the first layer 85*a*.

By adjusting parameters such as concentration of a plating solution, intensity of plating current, a plating rate, and the like, a first layer 85, which may be formed as a nickel plating layer, may have a spacing portion disposed around regions corresponding to tips 231 and 232 of an insulating substrate 23. In this case, the tips 231 and 232 of the insulating substrate 23 may be exposed from the first layer 85. Thus, a second layer 85*b*, formed after the first layer 85*a*, may be in contact with an exposed region of the insulating substrate 23.

As described above, according to the present disclosure, even if a chip size is decreased, the quality of a coil electronic component may be improved by increasing an area in which a coil portion is formed within the same chip size.

In addition, performance such as inductance L, a quality factor Q, and the like, may be improved by significantly reducing an influence of a mounting substrate and an external electrode interfering with a flow of magnetic fix.

Furthermore, high performance may be implemented by increasing an area of a core portion in a coil portion, a degree of freedom in design of a margin portion between an outermost portion of the coil portion and an exterior of a body, and the like, which is limited as a chip size is decreased.

While example embodiments have been shown and described above, it will be apparent to those skilled in the art that modifications and variations could be made without departing from the scope of the present disclosure as defined by the appended claims.

What is claimed is:

1. A coil electronic component:

a body having a first surface and a second surface opposing each other, and a third and a fourth surface opposing each other and connecting the first surface and the second surface to each other;

an insulating substrate disposed inside the body;

first and second coil portions respectively disposed on opposing surfaces of the insulating substrate;

a first lead-out portion having an L-shape, connected to one end of the first coil portion, and exposed from the first surface and the third surface of the body;

a second lead-out portion having an L-shape, connected to one end of the second coil portion, and exposed from the second surface and the third surface of the body; and first and second external electrodes respectively covering the first and second lead-out portions, wherein the insulating substrate comprises:

a support portion supporting the first and second coil portions, a first tip exposed from the first and third surfaces of the body, having an L-shape to correspond to the first lead-out portion, and supporting the first lead-out portion, and a second tip exposed from the second and third surfaces of the body, having an L-shape to correspond to the second lead-out portion, and supporting the second lead-out portion.

2. The coil electronic component of claim 1, wherein the insulating substrate has a thickness of 10 μm or more and 30 μm or less.

3. The coil electronic component of claim 1, wherein each of the first and second lead-out portions has a width narrower than a width of the body.

4. The coil electronic component of claim 1, wherein the first and second lead-out portions extend from the first and second surfaces of the body to be led out to the third surface of the body, respectively.

5. The coil electronic component of claim 1, wherein the first and second lead-out portions are not disposed on the fourth surface of the body.

6. The coil electronic component of claim 1, further comprising:

a first dummy lead-out portion disposed on a surface of the insulating substrate opposing the first lead-out portion; and a second dummy lead-out portion disposed on a surface of the insulating substrate opposing the second lead-out portion.

7. The coil electronic component of claim 1, wherein each of the first and second external electrodes has a width narrower than a width of the body.

8. The coil electronic component of claim 1, wherein the first and second external electrodes extend from the first surface and the second surface of the body to be disposed on the third surface of the body, respectively.

9. The coil electronic component of claim 1, wherein the first and second external electrodes are not disposed on the fourth surface of the body.

10. The coil electronic component of claim 1, wherein each of the first and second external electrodes comprises a first layer, covering the first and second lead-out portions, and a second layer covering the first layer.

11. The coil electronic component of claim 10, wherein the first layer comprises nickel (Ni), and the second layer comprises tin (Sn).

12. The coil electronic component of claim 10, wherein the second conductive layer is in direct contact with the insulating substrate through the concave portion.

13. The coil electronic component of claim 1, further comprising:

an insulating layer disposed on a surface of the body.

14. The coil electronic component of claim 13, wherein the insulating layer is disposed in a region except for regions in which the first and second external electrodes are disposed.

15. The coil electronic component of claim 13, wherein the insulating layer is formed of an oxide including at least one selected from the group consisting of iron (Fe), niobium (Nb), silicon (Si), chromium (Cr), and alloys thereof.

16. The coil electronic component of claim 1, wherein the body comprises metal magnetic powder particles.

17. The coil electronic component of claim 16, wherein the metal magnetic powder particles comprise at least one of iron (Fe), niobium (Nb), silicon (Si), chromium (Cr), and alloys thereof.

18. A coil electronic component:

a body having a first surface and a second surface opposing each other, and a third and a fourth surface opposing each other and connecting the first surface and the second surface to each other;

an insulating substrate disposed inside the body;

first and second coil portions respectively disposed on opposing surfaces of the insulating substrate;

a first lead-out portion connected to one end of the first coil portion and exposed from the first surface and the third surface of the body;

a second lead-out portion connected to one end of the second coil portion and exposed from the second surface and the third surface of the body; and first and second external electrodes respectively covering the first and second lead-out portions, wherein the insulating substrate comprises:

a support portion supporting the first and second coil portions, a first tip exposed from the first and third surfaces of the body and supporting the first lead-out portion, and a second tip exposed from the second and third surfaces of the body and supporting the second lead-out portion, wherein each of the first and second external electrodes comprises a first layer, covering the first and second lead-out portions, and a second layer covering the first layer, and a concave portion is disposed on a surface of the first layer.

19. The coil electronic component of claim 18, wherein the concave portion is disposed in a region covering the insulating substrate on the first layer.

20. A coil electronic component:

a body having a first surface and a second surface opposing each other, and a third and a fourth surface opposing each other and connecting the first surface and the second surface to each other;

an insulating substrate disposed inside the body;

first and second coil portions respectively disposed on opposing surfaces of the insulating substrate;

a first lead-out portion disposed on the insulating substrate, connected to one end of the first coil portion, and exposed from the first surface and the third surface of the body;

a second lead-out portion disposed on the insulating substrate, connected to one end of the second coil portion, and exposed from the second surface and the third surface of the body; and first and second external electrodes respectively covering the first and second lead-out portions, wherein each of the first and second external electrodes includes a first conductive layer disposed on a respective one of the first and second lead-out portions, and a second conducive layer covering the first conducive layer, and the first conductive layer has a concave portion on a portion of the insulating substrate exposed from the body.

21. The coil electronic component of claim 20, wherein the first conductive layer comprises nickel (Ni), and the second conductive layer comprises tin (Sn).

22. The coil electronic component of claim 20, further comprising:

a first dummy lead-out portion disposed on a surface of the insulating substrate opposing the first lead-out portion, exposed from the first and third surfaces, and covered by the first external electrode; and a second dummy lead-out portion disposed on a surface of the insulating substrate opposing the second lead-out portion, exposed from the second and third surfaces, and covered by the second external electrode.

23. The coil electronic component of claim 20, wherein the first and second coil portions and the insulating substrate are perpendicular or substantially perpendicular to the third surface or the fourth surface.

24. The coil electronic component of claim 20, wherein the second conductive layer is in direct contact with the insulating substrate through the concave portion.

25. The coil electronic component of claim 20, wherein the first external electrode extends from the first surface onto the third surface of the body, and the second external electrode extends from the second surface onto the third surface of the body.

26. The coil electronic component of claim 25, wherein the first external electrode is disposed on only the first and third surfaces of the body among exterior surfaces of the body, and the second external electrode is disposed on only the second and third surfaces of the body among the exterior surfaces of the body.

27. A coil electronic component:

a body having a first surface and a second surface opposing each other, and a third and a fourth surface opposing each other and connecting the first surface and the second surface to each other;

an insulating substrate disposed inside the body;

first and second coil portions respectively disposed on opposing surfaces of the insulating substrate;

a first lead-out portion disposed on the insulating substrate, connected to one end of the first coil portion, and exposed from the first surface and the third surface of the body;

a second lead-out portion disposed on the insulating substrate, connected to one end of the second coil portion, and exposed from the second surface and the third surface of the body;

first and second external electrodes respectively covering the first and second lead-out portions; and an oxide covering portions of the body and extending from a region of the body where one of the first and second external electrodes is connected to a respective one of the first and second lead-out portions, wherein the oxide is an oxide of a material selected from the group consisting of iron (Fe), niobium (Nb), chromium (Cr), and alloys thereof.

28. The coil electronic component of claim 27, wherein the oxide is an oxide of a composition composing metal magnetic powder particles disposed inside the body.

29. The coil electronic component of claim 27, wherein the first and second coil portions and the insulating substrate are perpendicular or substantially perpendicular to the third surface or the fourth surface.

30. The coil electronic component of claim 27, wherein the oxide covers an entirety of external surfaces of the body except regions of the external surfaces covered by the first and second external electrodes.

31. The coil electronic component of claim 27, wherein each of the first and second external electrodes includes a first conductive layer disposed on a respective one of the first and second lead-out portions, and a second conducive layer covering the first conducive layer.

32. The coil electronic component of claim 31, wherein a thickness of the oxide is less than a thickness of the first conductive layer.

33. The coil electronic component of claim 31, wherein the first conductive layer comprises nickel (Ni), and the second conductive layer comprises tin (Sn).

* * * * *